US007055931B2

(12) United States Patent
West et al.

(10) Patent No.: US 7,055,931 B2
(45) **Date of Patent: *Jun. 6, 2006**

(54) AUTOMATIC STARTUP FOR A SOLVENT INK PRINTING SYSTEM

(75) Inventors: Kenneth J. West, Dayton, OH (US); Meagan A. Wimmers, Springboro, OH (US); Jay D. Frazier, Jamestown, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/006,442

(22) Filed: Dec. 7, 2004

(65) Prior Publication Data

US 2005/0083368 A1 Apr. 21, 2005

Related U.S. Application Data

(63) Continuation of application No. 10/264,736, filed on Oct. 4, 2002, now Pat. No. 6,848,767.

(51) Int. Cl.
*B41J 2/165* (2006.01)

(52) U.S. Cl. ..... 347/28

(58) Field of Classification Search ..... 347/28, 347/22, 24–27, 5, 90, 73–77, 85; 134/22.1
See application file for complete search history.

(56) References Cited

U.S. PATENT DOCUMENTS 3,891,121 A 6/1975 Stoneburner et al.
4,600,928 A 7/1986 Braun et al.
4,622,562 A 11/1986 Pipkorn et al.
5,126,752 A 6/1992 Weinberg
5,757,396 A 5/1998 Bruner
6,145,954 A 11/2000 Moore
6,273,103 B1 8/2001 Enz et al.
6,435,637 B1 8/2002 Lyman
6,848,767 B1 * 2/2005 West et al. ..... 347/28

OTHER PUBLICATIONS

U.S. Appl. No. 10/264,736 patented on Feb. 1, 2005 U.S. Pat. No. 6,848,767 B2, filed Oct. 4, 2002 in the name of Kenneth J. West, et al.

* cited by examiner

*Primary Examiner*—Shih-wen Hsieh
(74) *Attorney, Agent, or Firm*—William R. Zimmerli

(57) ABSTRACT

An automatic start-up for a continuous ink jet printer provides a dyeless flush fluid to the printhead to remove any particles or ink residue from the printhead and to wet the orifice plate before jets form. The pressure of the flush fluid is then raised to cause the flush fluid to begin jetting from the drop generator. Once jets are established, ink is supplied to the drop generator at the pressure of the jetting flush fluid. The flow of flush fluid is stopped. Since the printhead is being supplied with ink, ink replaces the flush fluid as the fluid being jetted from the drop generator. An ink heater is then turned on, increasing evaporation of solvent from the ink jetted from the drop generator. The solvent vapors condense on the relatively cool charge plate and catcher face. The condensate forming on these surfaces provides one final rinse of these surfaces to remove conductive ink from the charge leads and catcher face. After a period of condensate cleaning, the ink heater is turned off, and a heater attached to the charge plate catcher assembly is turned on to dry the charge plate and catcher. Charge voltage may then be turned on to deflect the ink drops into catch. At this point, the printhead is ready for printing.

6 Claims, 1 Drawing Sheet

AUTOMATIC STARTUP FOR A SOLVENT INK PRINTING SYSTEM

CROSS REFERENCE TO RELATED APPLICATION

This is a continuation of U.S. application Ser. No. 10/264,736, entitled "Solvent Ink Startup Method," filed Oct. 4, 2002, now U.S. Pat. No. 6,848,767 and assigned to the Eastman Kodak Company.

TECHNICAL FIELD

The present invention relates to solvent ink printing systems and, more particularly, to an automatic startup process for a continuous ink jet printhead operating with solvent ink.

BACKGROUND ART

Ink jet printing systems are known in which a printhead defines one or more rows of orifices which receive an electrically conductive recording fluid from a pressurized fluid supply manifold and eject the fluid in rows of parallel streams. Printers using such printheads accomplish graphic reproduction by selectively charging and deflecting the drops in each of the streams and depositing at least some of the drops on a print receiving medium, while others of the drops strike a drop catcher device.

During the automatic startup sequence of a continuous ink jet printhead, the ink jets under pressure are stimulated to form uniform droplets that fall past the charge plate and catcher, but are caught in the sealing area of the eyelid seal and catch pan assembly and then are ingested into the catcher throat and returned to the fluid system by vacuum.

Over the years, a number of inkjet printers using binary array continuous inkjet printing have been developed, with continuing improvements in speed, reliability, and ease of use. These printers are used in a variety of print applications, often using aqueous inks. Using aqueous ink, these printers can print for hours and have demonstrated highly reliable automatic startups without operator intervention. In spite of advances in aqueous ink technology, solvent inks, such as ethanol or MEK based inks, are preferred for some applications. For example, in applications such as printing on metals or plastics, solvent inks are preferred over aqueous inks as a result of the solvent ink characteristics of being much faster drying and more permanent than aqueous inks.

The same characteristics that make solvent inks preferred for printing on metals and plastics, however, make solvent inks much harder to run in inkjet printers. Just as the inks dry quickly on the print media, they also dry quickly on the various components in an inkjet printhead and fluid system. In particular, these inks can dry quickly on the orifice plate and the charge plate in the printhead. On the orifice plate, the dried ink can plug the orifices through which the ink is to be jetted, adversely interfering with jet directionality. When dried on the charge plate, the dried ink can produce shorting conditions between charging electrodes.

As a result of these problems, prior art inkjet printers using solvent inks have required significant intervention by highly trained operators, for proper operation both when the printers are started and shutdown. There is a need for a printer for use with highly volatile solvent based inks which can be started up reliably without the need for operator intervention. This need is met by the present invention.

A need therefore exists to be able to apply an automatic startup for a printer using the highly volatile solvent based inks that offers reliable start up without operator intervention.

SUMMARY OF THE INVENTION

This need is met by the automatic startup according to the present invention, wherein both condensation and a flush fluid are used to remove ink residue from the leads of the printhead. The flush fluid is the make-up fluid for the ink. The condensation is created using a coiled tube heater.

In accordance with one aspect of the present invention, an automatic startup method is provided for an inkjet printer that uses volatile inks for printing. Initially in the startup method, a colorless flush fluid is provided which readily dissolves the ink. The flush fluid is crossflushed through the drop generator and caused to weep out of the orifices in the drop generator to dissolve and rinse away ink residues from the charge plate and the exterior of the orifice plate. The flush fluid is jetted from the drop generator orifices, and the jetted fluid is changed from flush fluid to ink without stopping the jetting of the fluid. The charge plate is rinsed with condensation produced by heating the jetting fluid.

Other objects and advantages of the invention will be apparent from the following description, the accompanying drawings and the appended claims.

DETAILED DESCRIPTION OF THE PREFERRED EMBODIMENTS

Figure 1:
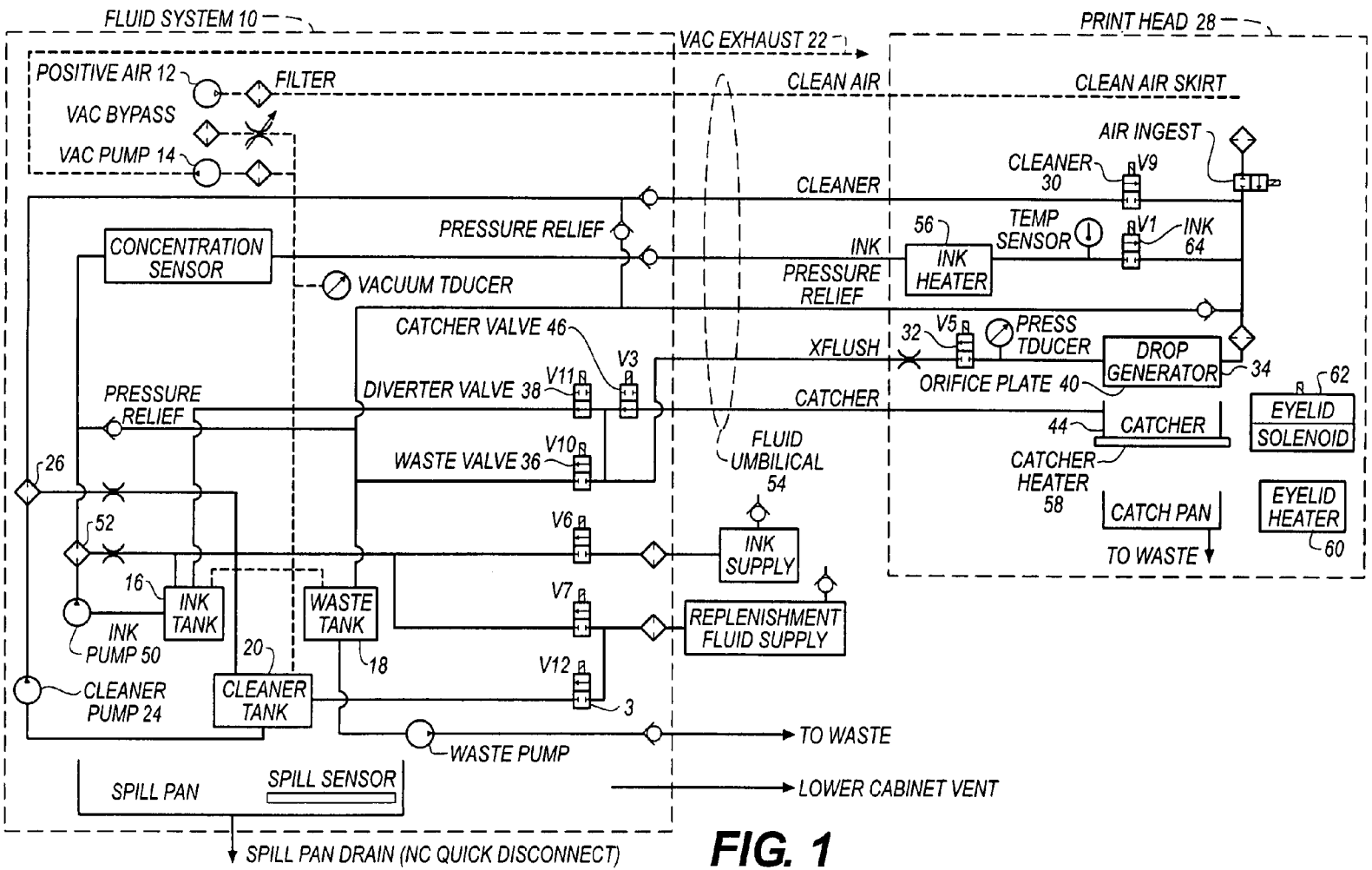
FIG. 1 is a block diagram illustration a fluid system with which the automatic startup of according to the present invention can be applied.

In accordance with the present invention, the automatic startup can be applied to a fluid system configured with one or more printheads. Since the separate inlets and outlets within each printhead interface controller (PIC) and printhead is identical, the following description will make reference only to a single printhead, without restricting the invention to use with a fluid system having only a single printhead.

The present invention allows an operator to go from a down state to a printing state automatically with the push of a button and without any additional intervention. The invention provides two key advantages to the operator. First, the operator can start-up the printhead automatically without having to be at the machine or involved with the start-up. Second, the automatic start-up is a key safety feature. Current ink jet printheads that use solvent require a solvent fluid to be sprayed on the printhead to clean it. The automatic start-up of the present invention allows the operator to bring up the printhead without being exposed to harmful or flammable fluids that may pose a health or safety risk. In a typical embodiment, the startup button can be on the control panel of the printer, and/or startup can be selectable from a host computer menu.

The automatic start-up according to the present invention provides a dyeless flush fluid to the printhead to remove any particles or ink residue from the printhead and to wet the orifice plate before jets form. The pressure of the flush fluid is then raised to cause the flush fluid to begin jetting from the drop generator. Once jets are established, ink is supplied to the drop generator at the pressure of the jetting flush fluid.

The flow of flush fluid is stopped. Since the printhead is being supplied with ink, ink replaces the flush fluid as the fluid being jetted from the drop generator. An ink heater is then turned on, increasing evaporation of solvent from the ink jetted from the drop generator. The solvent vapors condense on the relatively cool charge plate and catcher face. The condensate forming on these surfaces provides one final rinse of these surfaces to remove conductive ink from the charge leads and catcher face. After a period of condensate cleaning, the ink heater is turned off, and a heater attached to the charge plate catcher assembly is turned on to dry the charge plate and catcher. Charge voltage may then be turned on to deflect the ink drops into catch. At this point, then, the printhead is ready for printing.

Referring now to FIG. 1, the automated startup sequence is described with reference to the fluid system schematic 10 that facilitates the startup. The startup sequence begins with turning on air pump 12. This provides a positive pressure in the printhead, reducing the concentration of flammable vapor in the printhead. A vacuum pump 14 is turned on to create a vacuum in the ink tank 16, waste tank 18, and the cleaner tank 20. The exhaust from the vacuum pump is directed to an exhaust port 22 on the exterior of the fluid system cabinet. This prevents a buildup of solvent vapors inside the fluid system cabinet. It also provides a convenient means to direct these vapors into fire safe room exhaust means. Cleaner fluid pump 24 is turned on to pump flush fluid from the cleaner fluid tank 20 through filter means 26 and up to the printhead 28. Cleaner fluid valve 30 and crossflush valve 32 are open to allow the flush fluid to be pumped though the droplet generator 34 of the printhead. With waste valve 36 open and diverter valve 38 closed, flush fluid flows from the printhead to the waste tank 18, aided by the vacuum on the waste tank 18.

The flush fluid is then pumped to the printhead at a high enough flow rate to produce approximately 1 psi at the drop generator, with the crossflush valve 32 open. Pressurizing the drop generator 34 to this pressure causes flush fluid to weep out of the orifices of the droplet generator. This weeping crossflush serves to seep dried ink and other particles out of the drop generator. It also redissolves any dried ink present in the orifices. The flush fluid weeping out of the orifices also begins rinsing off the exterior of the orifice plate 40, associated charge plate, and the catcher 44 face. This ink flows out of the catcher 44 to the waste tank 18 through the open catcher valve 46 and waste valve 36, as a result of the vacuum on the waste tank 18. The diverter valve 38 is closed to prevent the used flush fluid from flowing into the ink tank 16.

This weeping crossflush state is followed by a state having lower flow rate through the drop generator 34. At this reduced flow rate, the vacuum on the waste tank 18 is sufficient to produce a slight vacuum at the drop generator 34. The vacuum at the droplet generator is at a level that is too high for the fluid to be able to exit through the orifices of the drop generator. Instead, the vacuum causes air to be ingested into the drop generator up through the orifices to remove any particles on the inside of the orifice plate.

These weeping crossflush and air ingest states are repeated with extremely high "super-stim" stimulation amplitudes applied to the drop generator. Super-stim, known in the art and as defined, for example, in U.S. Pat. No. 4,600,928, involves applying an AC voltage to piezoelectric drive crystals on the droplet generator 34 at a level such that the vibration of the droplet generator shakes any remaining particles free from the orifice plate. The "super-stim" is first applied during a weeping crossflush, and then during an air ingest crossflush. The super-stim states are followed by another weeping crossflush of the drop generator, this time with flush fluid, to remove any residue that may remain on the catcher 44 face or in the gap between the orifice plate and the charge plate.

The crossflush valve 32 is closed and the cleaner pump 24 is servo-controlled to raise the flush fluid pressure in the drop generator to the necessary pressure, for example, 7.5 psi, forming jets of the flush fluid out of the orifices. As the ink pressure is rising to the desired pressure, for example, 7.5 psi, the rapid flow of ink out of the orifices pulls any fluid out of the gap between the orifice plate and the charge plate.

Once the jetting of flush fluid is established, ink pump 50 is turned on to pump ink from the ink tank 16, through the filter 52, and up to the printhead 28 via umbilical 54. The ink pump 50 is driven to match the output from the cleaner fluid pump 48. This can be done by energizing both pumps to equal voltages, creating a printhead pressure of 7.5 psi. At this ink pressure, the ink supply valve 64 is now opened, the cleaner fluid valve 30 closed, and the cleaner fluid pump is turned off. Ink now replaces the flush fluid as the fluid being jetted from the orifices of the drop generator. This transition from flush fluid to ink, while fluid is being jetted, occurs with minimal disturbance to the jets. With ink now jetting from the orifices, the waste valve 36 is closed and the diverter valve 38 opened to direct ink from the catcher 44 back to the ink tank 16.

At this point in the startup, the ink heater 56 is energized, increasing the ink temperature 30° F. over the ambient temperature. This causes the solvent to evaporate rapidly from the jetted ink. The solvent vapors condense on the relatively cool charge plate and catcher face. The solvent condensate dissolves any remaining ink from the face of the printhead and the catcher face. This condensate is pulled into the catcher throat and flows to the waste tank 18, as a result of the vacuum on that tank.

After a predetermined period of time, for example about two minutes, the ink heater 56 is turned off, allowing the ink to cool back to ambient temperature. A heater 58 associated with the catcher 44, and located under the charge plate, such as is taught by U.S. Pat. No. 4,622,562, can be used to raise the temperature of the face of the charge plate, which removes any condensate from the face or the charge plate and catcher. A separate heater 60, associated with the eyelid 62, may be used to eliminate condensate on the eyelid as well. Once the charge plate face is dried by the heater 58, a voltage, typically on the order of sixty volts, is applied to the charge leads in the printhead, which starts to deflect the jets. The full operating point charge voltage may now be applied to the charge leads in the printhead, taking all of the jets into a catch condition. The printhead is now ready for printing.

Having described the invention in detail and by reference to the preferred embodiment thereof, it will be apparent that other modifications and variations are possible without departing from the scope of the invention defined in the appended claims.

The invention claimed is:

1. A method for starting a continuous inkjet printer having a printhead with an associated droplet generator and orifice plate, the method comprising:

providing a flush fluid which readily dissolves the ink;

crossflushing the flush fluid through the drop generator;

causing the flush fluid to weep out of drop generator orifices in the orifice plate of the drop generator to dissolve and rinse away ink residues from a charge plate associated with the drop generator and an exterior of the orifice plate;

causing the flush fluid to flow into the drop generator while the drop generator is substantially unpressurized;

causing the flush fluid to be jetted from the drop generator orifices; and changing the jetted fluid from flush fluid to ink without stopping jetting of fluid from the drop generator orifices.

2. The method of claim 1, wherein causing the flush fluid to flow into the drop generator while the drop generator is substantially unpressurized comprises pumping the flush fluid.

3. The method of claim 1, further comprising: rinsing the charge plate with condensation produced by heating the jetting fluid.

4. An automatic startup system for starting up a continuous inkjet printer having a printhead with an associated drop generator and orifice plate comprising:

means for cross flushing a flush fluid through the drop generator;

means for causing the flush fluid to weep out of orifices in the orifice plate of the drop generator to dissolve and rinse away ink residues from a charge plate associated with the drop generator and an exterior of the orifice plate;

means for causing the flush fluid to flow into the drop generator while the drop generator is substantially unpressurized;

means for jetting the flush fluid from the orifices in the orifice plate of the drop generator; and means for changing the jetted fluid from flush fluid to ink without stopping jetting of fluid from the drop generator orifices.

5. The system of claim 4, wherein the means for causing the flush fluid to flow into the drop generator while the drop generator is substantially unpressurized comprises a pump.

6. The system of claim 4, further comprising:

means for rinsing the charge plate with condensation produced by heating the jetting fluid.

* * * * *